United States Patent [19]

Savage

[11] 3,981,248

[45] Sept. 21, 1976

[54] TIMING GATE FOR SKI-LIFTS

[75] Inventor: Phillip D. Savage, Owls Head, N.Y.

[73] Assignee: Hall Ski-Lift Company, Inc., Watertown, N.Y.

[22] Filed: Feb. 28, 1975

[21] Appl. No.: 554,200

[52] U.S. Cl. ..... 104/173 ST; 49/29; 49/31; 49/49

[51] Int. Cl.[2] ..... B61B 12/00

[58] Field of Search..... 104/173, 178, 1 R, 28, 104/30, 18, 20, 27; 49/46, 47, 13, 31, 49, 263, 265, 29; 246/261, 272

[56] References Cited

UNITED STATES PATENTS

| | | | |
|---|---|---|---|
| 1,706,318 | 3/1929 | Orr | 246/261 X |
| 1,737,088 | 11/1929 | Kahler | 246/272 |
| 3,044,764 | 7/1962 | Bonner | 49/265 X |
| 3,348,378 | 10/1967 | Lemley | 246/261 X |
| 3,548,753 | 12/1970 | Thurston | 104/173 |
| 3,561,366 | 2/1971 | Pomagalski | 104/173 |
| 3,662,229 | 5/1972 | Graff et al. | 49/31 X |

*Primary Examiner*—L. J. Paperner
*Assistant Examiner*—Randolph A. Reese
*Attorney, Agent, or Firm*—Bruns & Jenney

[57] ABSTRACT

A timing gate adapted to admit passengers to a chair ski-lift loading area is synchronized with the lift to allow passengers in the required number to approach crossing the path of the chairs around the lower bull-wheel. At a timed interval after a chair has passed a chair operated switch, the gates open for a brief interval, a red light is turned off and a green light is turned on, and a gong is struck. After the brief interval the gates close and are locked and the green light is changed back to red. A weight operated switch may be used to prevent opening of the gates unless there are passengers waiting or the gate may open automatically after the passage of each chair. An inverted U-shaped frame has a pneumatic cylinder attached to each leg, the piston of each has secured thereto a rod-like gate projecting transversely through a helically extending slot in the cylinder 90° therearound. Compressed air is conducted by tubing to either end of each cylinder and a solenoid operated reversing valve normally lowers the cylinders to close and lock the gates but, on a signal from the chair operated switch and through a time delay relay, the valve is reversed to admit air to the bottom of the cylinders to raise them briefly and to operate the gong and change the lights.

1 Claim, 6 Drawing Figures

TIMING GATE FOR SKI-LIFTS

BACKGROUND OF THE INVENTION

This invention relates to a gate device for automatically admitting passengers in the required number to a loading area of a ski-lift, the opening of the gate being synchronized with the passage of the carriers on the lift.

Turnstyle and other gate devices heretofore known have been concerned with counting passengers or collecting fares and usually are designed to keep passersby in single file or in parallel files.

Recent experiments with chair-lift loading patterns have demonstrated the need for automatic passenger control means synchronized with the passage of the chairs on the lift to admit to the loading area only the proper number of passengers comprising a load for each chair. Furthermore, such experiments include so-called bullwheel-loading systems where passengers to be loaded pass across the path of approaching chairs so as to be aligned with the upward path the chairs are to take thus eliminating the need for the passengers to make a partial turn when reaching the loading area.

An important object of the invention is to provide a gate in the path of passengers approaching the loading area of a ski-lift which cycles in direct relationship to the frequency of the passing carriers and to restrain the passengers to keep them safely out of the travel path of the carriers and yet signal them to advance to the loading area with optimum promptness and in numbers comprising not more than a load for the next approaching carrier.

SUMMARY OF THE INVENTION

The present invention contemplates a gateway having an inverted U-shaped tubular frame with suitable feet for maintaining the frame upright. On each leg of the frame at substantially waist-high level is secured a two-way pneumatic cylinder whose piston is adapted to move up and down.

The gates may conveniently be rod-like members secured to the center of each piston and projecting transversely therefrom through helically spiral slots through the cylinder walls, each slot extending 90° therearound. The slots are oriented so that when the piston is in its lower position the gates are closed and when the piston is raised the gates swing open toward the loading area.

The pistons are operated by conducting compressed air from a source through an electrically operated reversing valve and through appropriate tubing to one end or the other of the cylinders. In normal position the air is conducted to the upper end of the cylinders for closing and locking the gates. When the reversing valve is operated air is conducted to the lower end of the cylinders opening the gates, in each case the spiral slots operating to open and close the gate members.

The opening and closing of the gates is synchronized with the passage of the carriers on the lift by means of a feeler switch which is operated by the passing of each chair past a chosen point. This point is preferably somewhere as the chairs are carried around the bullwheel which drives the lift before the chair approaches the path the passengers must take from the gate to the loading area.

When the feeler switch is operated by a passing chair a circuit is closed which operates a time delay relay, the time delay being regulated according to the speed of the lift and spacing of the chairs to allow the chair which has operated the feeler switch to clear the loading area. The time delay relay, after the regulated delay, operates to close a circuit to operate the solenoid of the reversing valve and also closes circuits to operate an audible signal and a visual signal to alert the passengers of the opening of the gates.

The time delay relay also has a time limit attachment which limits the time the gates are open to a brief period of one to three seconds. After this brief period the relay switch reverses allowing the solenoid operated valve to return to its normal position in which the gates are closed and locked and a red light is displayed at the gateway.

A weight-sensing switch may be placed at the approach to the gateway and placed in the circuit controlled by the time delay relay so that the gates will not swing open unless there are passengers waiting at the gate.

The width of the gateway frame may be designed for 1, 2, 3 or 4-passenger chairs. Most chair lifts are for two or three passengers in the chairs.

DESCRIPTION OF THE PREFERRED EMBODIMENT

Figure 1:
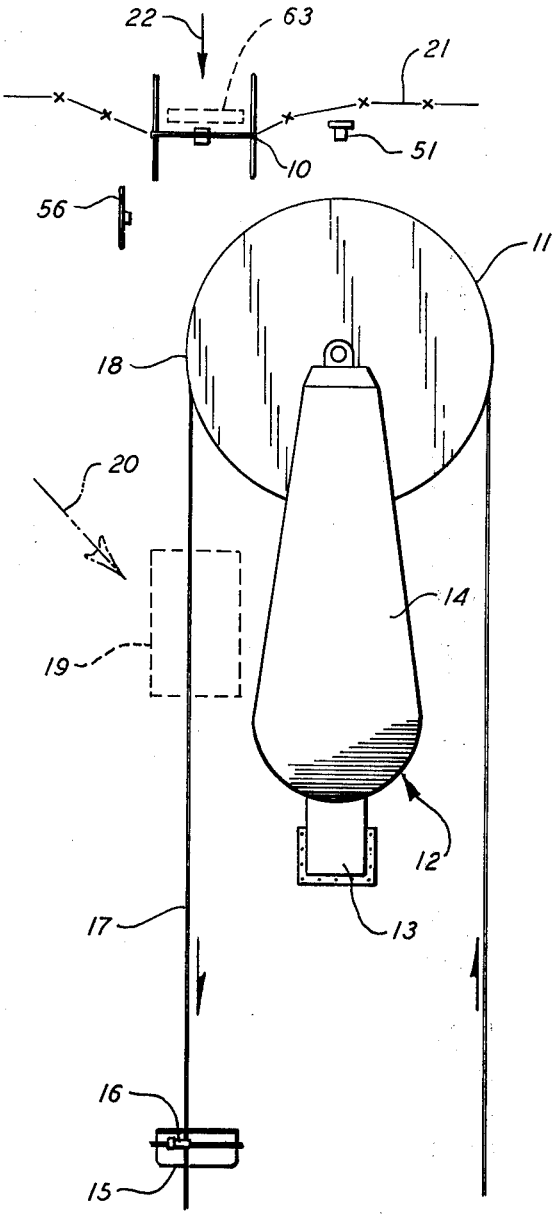
FIG. 1 is a plan view of a drive-bullwheel end of a ski lift, the cable being shown fragmentarily and showing a timing gate according to the invention.

Referring to FIG. 1, a downhill bullwheel portion of a ski-lift is shown with a gateway 10 according to the invention in position. The bullwheel 11, which may be assumed to be the drive bullwheel for the lift, is supported on a bullwheel support 12 having two legs resting on cement foundations sunk in the ground, the up-hill leg 13 being shown. It will be understood that the bullwheel 11 and the enlarged upper portion 14 of support 12 are elevated well above the heads of approaching passengers.

A chair 15, in this case for two passengers, is shown suspended from a grip 16 fastened to the uphill run of a cable 17. It will be understood that the cable 17 is supported on pulleys secured to towers at spaced intervals. Another bullwheel, not shown, is at the top of the hill near an unloading station and the cable passes around the uphill bullwheel carrying the empty chairs back down the hill where they pass around bullwheel 11, the cable leaving the bullwheel at the tangent point 18.

A loading zone 19 is indicated in broken lines beyond this tangent point. Until recently the approach to the loading was along a path indicated by the broken line arrow 20. It will be apparent that when the approaching passengers reach the loading zone 19 they must turn facing uphill and align their skis in the direction of the uphill run of cable 17 in order to be in position to load onto the next empty chair brought by the cable around bullwheel 11. The timing of the approaching passengers to the loading zone is entirely by a visual judgment of when chair 15 clears the loading zone.

With the bullwheel approach loading system, the gateway 10 is placed in an opening in a fence or other barrier 21. The direction of approach is indicated by the arrow 22. Since the bullwheel approach crosses the path of descending empty chairs before reaching loading area 19 it will be evident that the function of gate 10 is to hold back approaching passengers until the preceding chair has cleared the loading area and the succeeding chair has not yet rounded bullwheel 11. Furthermore, the gate is just wide enough to admit the required number of skiers abreast and must close quickly after opening to prevent additional skiers from approaching the loading area.

Figure 2:
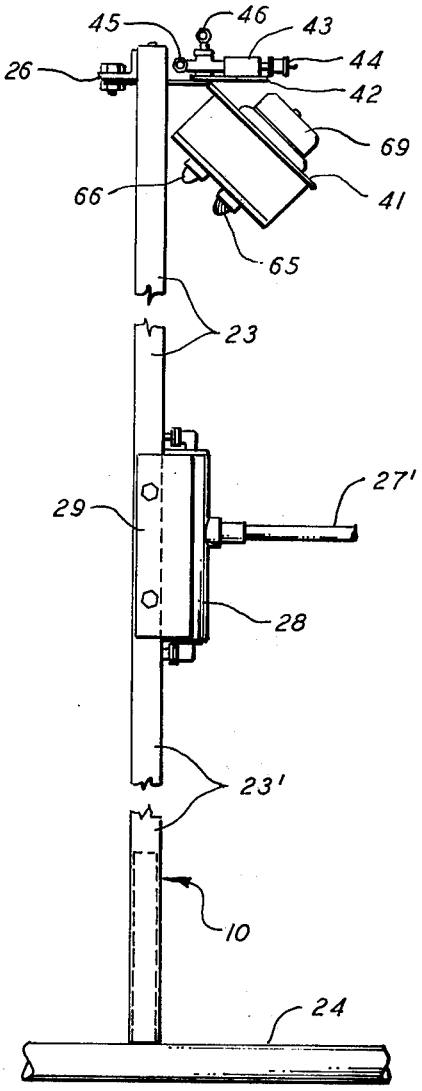
FIG. 2 is a fragmentary, enlarged side-elevational view of the gate as viewed from its left in FIG. 1, the gate members being shown in open position.
Figure 3:
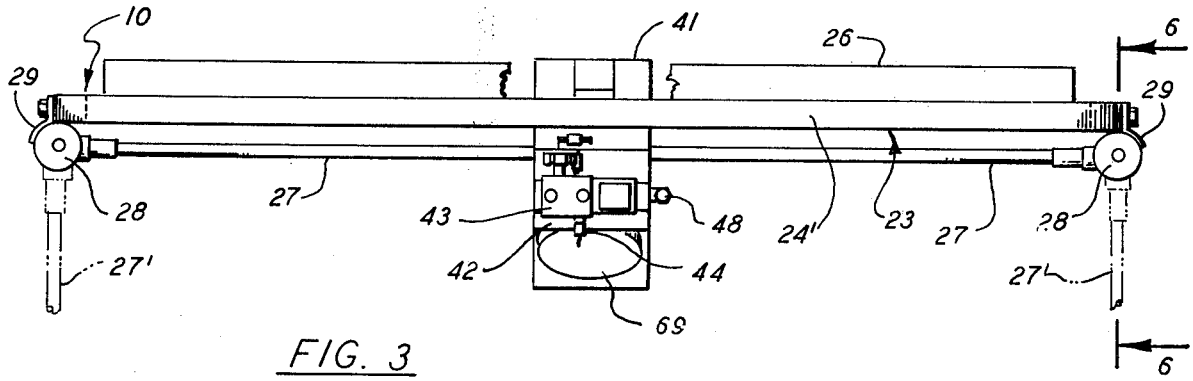
FIG. 3 is a fragmentary, enlarged plan view of the top portion of FIG. 2, a portion of a reinforcing angle being broken away at the center and the gate members being shown in full lines in closed position and in broken lines in open position.
Figure 4:
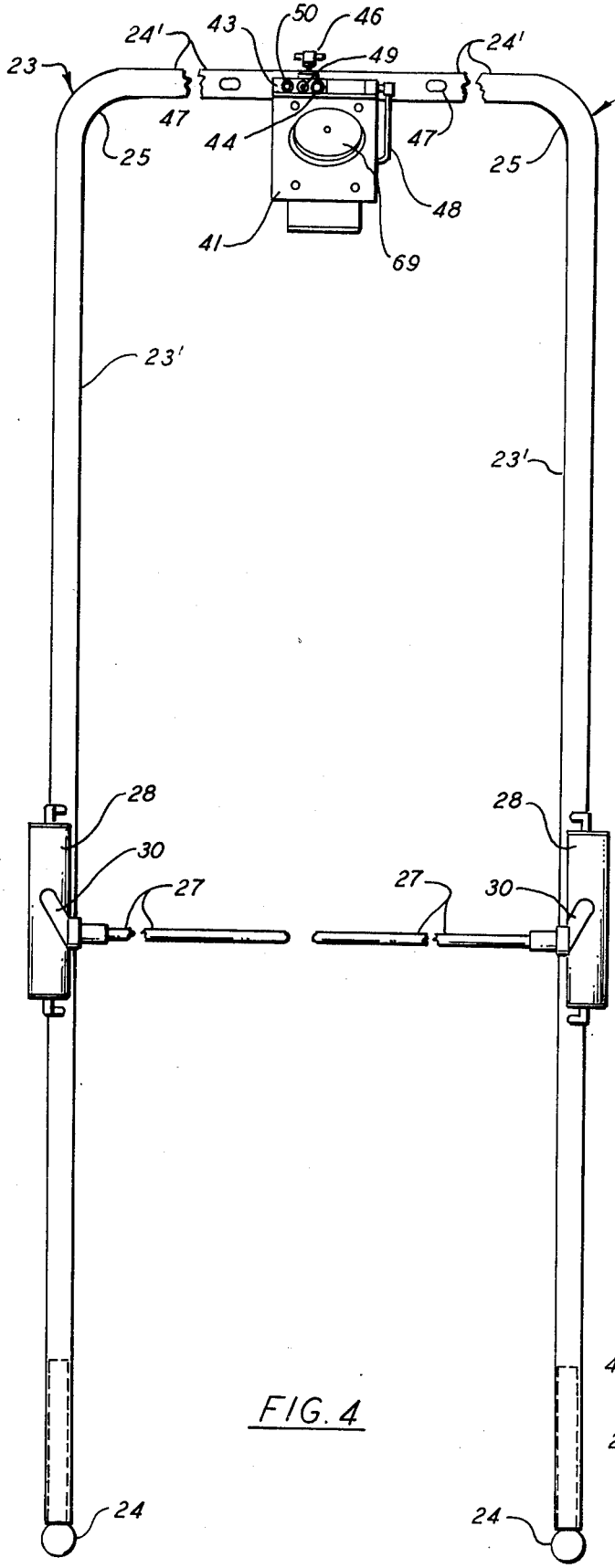
FIG. 4 is a fragmentary enlarged front view of the gate as viewed from the right in FIG. 2, the gate members being shown in closed position.

Referring to FIGS. 2, 3 and 4, the gate 10 is shown in general detail. An inverted-U-shaped frame 23 of tubular material, shown as rectangular tubing, has each of its legs 23' terminating in fore-and-aft extending horizontal feet 24 of metal pipe secured to legs 23' as by welding. The top crossarm 24' of the frame is preferably joined to the legs 23' by bent arcuate portions of the tubing at 25 and is reinforced by an angle 26 bolted thereto on the entrance side, as shown in FIG. 2. As best seen in FIG. 4, a gate member 27 projects substantially halfway across the gateway 10 at waist level and radially from a pneumatic cylinder 28 secured to each leg 23'. As shown in FIG. 2, a plate 29 may be welded to each cylinder and bolted to the supporting leg.

It will be understood that the frame 23 is of sufficient width for a skier behind each gate member 27 so that only two skiers can advance abreast through the gate when it opens. For chair lifts for three, the gate is wide enough for three, the third standing at the center of the gateway and for four-passenger lifts, each gate member is long enough for two skiers to stand therebehind. For single passenger lifts, of course, only one gate member and cylinder is necessary.

Figure 5:
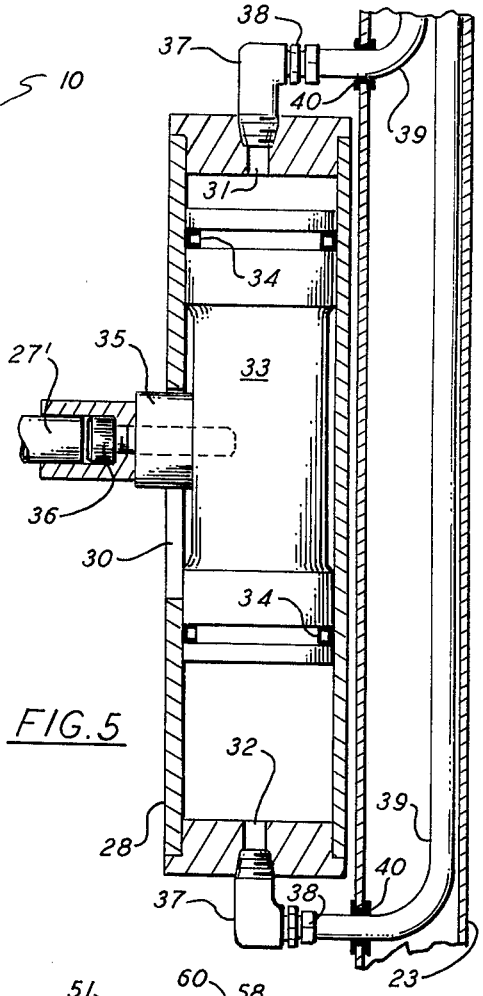
FIG. 5 is a fragmentary enlarged sectional view on the line 6—6 of FIG. 3, but with the gate member in open position.

Referring now to FIG. 5, each cylinder 28 has a helically extending slot 30 therethrough, also shown in FIG. 4, the slot extending for a quarter-turn around the cylinder. Cylinder 28 is double-acting and has an air entrance 31 at the upper end and an air entrance 32 at its lower end. In the cylinder 28, a piston 33 has a sealing ring 34 in an appropriate annular slot adjacent each end.

At the center of the piston, between the seals 34, a gate-member-receiving socket member 35 is secured by a screw 36 extending radially of the piston and through the slot 30, the slot being of such width as to guidingly contain member 35. The gate member 27 extends into the socket of member 35 and is adhesively or otherwise secured therein. Alternatively, the gate member 27 may be threadedly or otherwise connected directly to the piston. The gate member is preferably formed of a tough plastic resin material which does not splinter when accidentally broken and may be tubular or rod-like.

An appropriate pipe fitting 37 is secured in each of the entrances 31 and 32 and may have appropriate tubing fittings 38 secured thereto to which plastic tubing 39 may be secured extending through appropriate holes 40 to the interior of the leg 23'.

Figure 6:
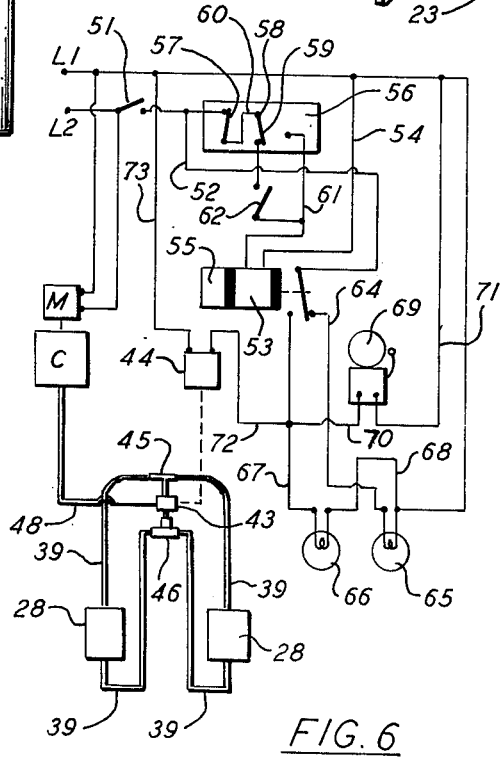
FIG. 6 is a diagrammatic view of the electrical and pneumatic circuits of the gateway.

Referring to FIGS. 2 and 3, a bent plate 41 is bolted to cross-arm 24' and angle 26 extending forward of arm 24'. Another plate 42 is secured to plate 41 and carries a reversing valve 43 which is operated by a solenoid 44. As best seen in FIG. 2, valve 43 has two tees 45 and 46 connected thereto and cross-arm 24' has two oblong holes 47 therethrough, as shown in FIG. 4. Although tubing 39 is not shown in FIGS. 2, 3 and 4, it will be understood that tubing 39 may be connected by appropriate fittings to each of the openings of each tee 45 and 46 and the tubing inserted in the holes 47 and then forced down along the interior of tubular cross-arm 24', one tube from each tee in either direction. The curved portions 25 of frame 23 guide the tubes 39 down the legs 23' to the holes 40 adjacent the ends of each cylinder 28. The tubing 39 may then be guided through the holes 40 by an appropriate hook and the fittings for pipe fittings 37 there attached and secured to the pipe fittings. As shown in FIG. 6, the tubing 39 from tee 45, for example, being connected to the upper entrance 31 of each cylinder and the tubing from tee 46 being connected to the lower entrances 32 of each cylinder.

The solenoid operated valve 43 is normally biased to a position directing air, led into the valve by tubing at 48 (FIG. 3) connected to a compressor C driven by a motor M (FIG. 6), to the upper entrances 31 of cylinders 28. In this position the lower entrances 32 are connected by tubing 39 to atmosphere through a vent 49 (FIG. 4) in valve 43 which is provided with a removable orifice. When solenoid 44 is activated, valve 43 is shifted to a position directing air from tubing 48 to the lower entrances 32 of the cylinders and, at the same time connecting the upper entrances 31 to atmosphere through a vent 50 (FIG. 4) also provided with a removable orifice. It will be understood that when valve 43 is in its first position piston 33 will be driven down and locked and the gate members will be in the closed position shown in FIG. 4. When solenoid 44 is activated and valve 43 is moved to its second position, as shown in FIG. 5, the piston 33 will be driven upward and the gate members 27, guided by the socket member 35 riding in the slots 30, will be swung 90° to their open position shown in broken lines in FIG. 3.

For coordinating the reversing of valve 33 with the passage of chairs 15 on the lift a feeler switch 51, as shown in FIG. 1, mounted on a suitable stake adjacent bullwheel 11 and having its operating arm activated by each passing chair. Alternatively, switch 51 may be mounted on the bullwheel support 13–14. Switch 51 may be a wand-type switch as shown, or a mercury switch mounted on a pivotted arm which moves the switch up, over and down each time a chair passes, or may be a photoelectric beam which is cancelled as the chair passes.

As shown in FIG. 6, switch 51 is connected by a wire 52 in a circuit between one terminal $L_2$ of a source of electric power to one terminal of a time delay relay 53, the other terminal of the relay being connected to the terminal $L_1$ of the source by a wire 54. The relay 53 is adjustably timed in coordination with the speed of cable 17 and the spacing of chairs 15 thereon, to delay the operation of the switch operated by the coil of the relay by an interval to allow the passage of the chair from the point of contact with switch 51 until the chair passes some portion of the loading area 19.

As shown in FIG. 6, relay 53 may also be provided with a time limiting attachment 55 which limits the time which solenoid 44 remains activated so that the gate members remain in their open position for an interval of the order of one to three seconds. The speed of the opening and closing of the gate members 27 may also be individually timed by the selection of the size of the orifices for the vents 49 and 50.

As shown in FIG. 1, a switch panel 56 is also provided adjacent the gate 10. As shown in FIG. 6, the panel 56 is provided with a first or shut-off switch 57, which when open cuts off power to all the gate opening mechanism except the Motor M. When switch 57 is closed one terminal 58 of a second switch 59 may be energized through a wire 60. When switch 59 is in one position its other terminal is connected directly by a wire 61 to the appropriate terminal of relay 53. In its second position, as shown in FIG. 6, switch 59 is connected to one terminal of a weight operated switch 62. Switch 62 is not shown in FIG. 1 but is operated by a ground level board or other device 63 for operating the switch 62 located at the entrance to gate 10. When there is no passenger or passengers standing on the board 63 the gate will not open.

As shown in FIG. 6, the relay 53, when unoperated, has a switch connecting wire 52 and a wire 64 connected to one terminal of a red light 65. As best seen in FIG. 2, the light 65 may best be located supported on the plate 41 facing down and toward any waiting passenger at the gate. Another light such as green light 66 may be supported alongside.

When the relay switch is in its operated position, when relay 53 is energized, it connects line 52, by a wire 67 to one terminal of the green light 66 to alert the waiting passengers of the opening of the gate and, at the same time, breaks the circuit to the red light 65. The other terminal of light 66 is connected by a wire 68 to the terminal $L_1$ of the source.

Motor M is connected directly to $L_1$ and $L_2$ and may be controlled by the usual switch, not shown, cutting off the motor when the pressure in the tank of compressor C reaches a predetermined pressure.

A bell or gong 69 is also supported on plate 41, as shown in FIG. 2, preferably of the type which strikes only once when energized. As shown in FIG. 6, bell 69 has one terminal connected by a wire 70 to wire 67 for operation when the green light 66 and solenoid 44 are energized, the other terminal being connected by a wire 71 to terminal $L_1$ of the source. Solenoid 44 has one terminal connected by wire 72 to wire 67 and its other terminal connected by a wire 73 to terminal $L_1$ of the source.

It will now be apparent that there has been provided an economically constructed gate, simply and reliably operated by air pressure means. Moreover, the electrical initiation of the operation of the gate, coordinated with the passing of the chairs, provides automatic protection to approaching passengers for the lift together with audible and visual alerting signals to those waiting at the gate for ensuring prompt action on the part of those waiting when the gate opens.

I claim:

1. A gateway for admitting a predetermined number of passengers abreast to a ski-lift loading area, comprising: an inverted U-shaped frame having two vertical legs and a cross arm and adapted to be supported erect on the ground, at least one two-way pneumatic cylinder secured at substantially waist-high level to a frame leg and having a piston with spaced seals adjacent either end, the cylinder having a helically-disposed quarter-turn slot in its wall, the piston in the cylinder having an elongated rod-like gate member secured thereto between the seals and projecting radially therefrom through the cylinder slot for guiding the gate member as the piston moves up and down, the gate member having a closed position transverse the gateway when at one end of the slot and an open position swung 90° from the closed position when at the other end of the slot, a source of compressed air under pressure, an electrically operated reversing valve, tube means for connecting the upper end of the cylinder through the valve to the source when the valve is in one position at the start of each cycle, tube means for connecting the lower end of the cylinder through the valve to the source when the valve is in its other position in its intermediate position in the cycle, a chair-sensing feeler switch operable by each passing chair, and electrically operated switch means connected in a circuit with the feeler switch for operating the reversing valve after a timed delay when the feeler switch is operated by a passing chair for initiating each succeeding cycle, the piston and gate member being adapted to fall by gravity to the gate closed position upon any failure of the source of compressed air.

* * * * *